US006151951A

United States Patent [19]

Kawano

[11] Patent Number: 6,151,951

[45] Date of Patent: Nov. 28, 2000

[54] UPPER TOOL HOLDING APPARATUS AND UPPER TOOL SEPARATING METHOD FROM UPPER TOOL HOLDING APPARATUS

[75] Inventor: Toshirou Kawano, Kanagawa, Japan

[73] Assignee: Amada Metrecs Company, Limited, Kanagawa, Japan

[21] Appl. No.: 09/261,239

[22] Filed: Mar. 3, 1999

[30] Foreign Application Priority Data

Mar. 4, 1998 [JP] Japan ..... 10-052389

[51] Int. Cl.[7] ..... B21D 37/04

[52] U.S. Cl. ..... 72/481.2; 72/482.91

[58] Field of Search ..... 72/481.2, 481.6, 72/482.1, 482.2, 482.91, 482.92

[56] References Cited

U.S. PATENT DOCUMENTS

| | | | |
|---|---|---|---|
| 5,022,256 | 6/1991 | Van Der Meulen | 72/482.91 |
| 5,511,407 | 4/1996 | Kawano | 72/482.91 |
| 5,513,514 | 5/1996 | Kawano | 72/482.91 |
| 5,572,902 | 11/1996 | Kawano | 72/482.91 |
| 5,619,885 | 4/1997 | Kawano et al. | 72/481.8 |
| 5,685,191 | 11/1997 | Kawano et al. | 72/481.92 |
| 5,794,486 | 8/1998 | Sugimoto et al. | 72/481.3 |
| 6,003,360 | 12/1999 | Runk et al. | 72/482.2 |

FOREIGN PATENT DOCUMENTS 8-57542 3/1996 Japan .

*Primary Examiner*—David Jones
*Attorney, Agent, or Firm*—Blank Rome Comisky & McCauley LLP

[57] ABSTRACT

An upper tool holding apparatus includes: an upper tool support portion provided under a holder main body to support an upper tool; an upper tool clamp which is supported in a swingable way with a fulcrum near the approximately central portion in the vertical direction of the holder main body; a pressing member provided at a lower portion of the upper tool clamp to press the upper tool to the upper tool support portion; an engaging member provided at the lower portion of the upper tool clamp; and a clamping force giving means pressing the upper portion side of the upper tool clamp so that the upper tool clamp can clamp the upper tool with the upper tool support portion. In the construction, the engaging member is provided by being divided into a plurality of pieces as engaging split fragments. Furthermore, the respective divided engaging split fragments are respectively provided by being urged in the direction of the upper tool support portion.

5 Claims, 5 Drawing Sheets

UPPER TOOL HOLDING APPARATUS AND UPPER TOOL SEPARATING METHOD FROM UPPER TOOL HOLDING APPARATUS

BACKGROUND OF THE INVENTION

1. Technical Field of the Invention

The present invention relates to an upper tool holding apparatus in a press brake and an upper tool separating method from the upper tool holding apparatus, and more specifically, relates to an upper tool holding apparatus in which the installation, removal, and replacement of an upper tool can easily be performed to an upper table in the press brake, and an upper tool separating method from the upper tool holding apparatus.

2. Description of the Related Art

Conventionally, a press brake is arranged such that an upper table (another name is an upper ram) and a lower table (another name is a lower ram) are provided vertically opposite to each other, and is arranged such that properly either of the upper table or the lower table is vertically driven as a ram.

In a press brake with the above arrangement, a lower tool (die) is provided above the lower table in order to perform the bending work of a plate-like workpiece, and under the upper table, an upper tool (punch) is provided.

In the above arrangement, after positioning the workpiece on the lower tool, the bending work of the workpiece can be performed by engaging the upper tool and the lower tool.

By the way, in the press brake, it is arranged that in order to replace the upper tool, for example, because of the difference in the bending shape of the workpiece or the like, a lot of upper tool holding apparatus are attached under the upper table, and the upper tool is supported at the upper table by a lot of these upper tool holding apparatus in such a way that installation, removal, and replacement are possible.

A conventional upper tool holding apparatus is arranged such that the upper tool clamp is attached in a swingable way through a fastening bolt to the holder main body mounted under the upper table, and the upper portion of the upper tool inserted between this upper tool clamp and the holder main body is intensely tightened and fastened with the upper tool clamp by tightening the fastening bolt.

Accordingly, in the conventional arrangement, in order that the installation, removal, and replacement of the upper tool are performed to the upper table, it is required to handle a lot of fastening bolts provided to a lot of upper tool holding apparatus, and there was such a problem that this handling was extremely troublesome and difficult.

Furthermore, in the conventional upper tool holding apparatus, it is required that when the upper tool is mounted, the upper tool clamp is lightly fastened so that the upper tool may not fall, and after that, the upper tool clamp is intensely fastened in the state where the upper tool and the lower tool have been adjusted and centered, and there was such a problem that the handling is troublesome.

By the way, as a preceding example relating to the present invention, for example, there is Japanese Patent Application Laid-Open No. Hei 8-57542. In this preceding example, it is arranged that the upper tool is clamped by an upper tool clamp pivotally attached to the upper table of the press brake in a freely swingable way, between that and the holder main body. However, for example, in the case where a plurality of upper tools are installed to or removed from the holder main body in order to efficiently perform a plurality of bending steps of one product, it is necessary that the plurality of upper tools are simultaneously installed to or removed from the holder main body.

However, in the case where it is wanted to replace only 1 piece of upper tool among the plurality of upper tools, it is required to install or remove all tools again, and furthermore, in the case where a plurality of upper tools are installed to or removed from the surface side (front side) and the back side (rear side) of the holder main body, it is also impossible to perform the installation or removal simultaneously to the surface side and the back side, and therefore, there was such a problem that the efficiency in the replacement of the upper tool was low.

SUMMARY OF THE INVENTION

The present invention is made to solve the above problems, and an object thereof is to provide an upper tool holding apparatus in which the installation, removal, and replacement of the upper tool are easily performed to the press brake, and especially, a plurality of upper tools can separately and easily be installed to and removed from a proper position in the back and forth and right and left directions of the holder main body, and an upper tool separating method from the upper tool holding apparatus.

To achieve the object, according to a first aspect of the present invention, there is provided an upper tool holding apparatus, comprising: a holder main body; an upper tool support portion provided under the holder main body to support an upper tool; an upper tool clamp which is supported in a swingable way with a fulcrum near the approximately central portion in the vertical direction of the holder main body; a pressing member provided at a lower portion of the upper tool clamp to press the upper tool to the upper tool support portion; an engaging member provided at the lower portion of. the upper tool clamp, the engaging member provided to freely be engaged with a falling preventing groove formed in the upper tool, the engaging member being urged in the direction toward the upper tool support portion; and a clamping force giving means provided in the holder main body, the clamping force giving means pressing the upper portion side of the upper tool clamp to give a clamping force to the upper tool clamp so that the upper tool clamp can clamp the upper tool with the upper tool support portion, herein the engaging member is provided by being divided into a plurality of pieces as engaging split fragments; and the respective divided engaging split fragments are respectively provided by being urged in the direction of the upper tool support portion.

Accordingly, each engaging split fragment is small, and in the meantime, it is individually and independently urged to the upper tool support portion side, and therefore, the upper tool is raised while easily pushing to the outside the tip portion of each engaging split fragment individually against the weak urging force, and the tip portion of each engaging split fragment is easily engaged with the falling preventing groove of the upper tool.

The operation is similarly easily performed when the upper tool is separated from the upper tool holding apparatus. By inclining downward properly one end side among both right and left sides of the upper tool, the falling preventing groove of the upper tool is easily separated from the engaging split fragment, while one end side of the upper tool pushes it to the outside easily against the urging force of the small engaging split fragment.

According to a second aspect of the present invention, there is provided an upper tool holding apparatus, comprising: a holder main body; an upper tool support portion provided under the holder main body to support an upper tool; an upper tool clamp which is supported in a swingable way with a fulcrum near the approximately central portion in the vertical direction of the holder main body; a pressing member provided at a lower portion of the upper tool clamp to press the upper tool to the upper tool support portion; an engaging member provided at the lower portion of the upper tool clamp, the engaging member provided to freely be engaged with a falling preventing groove formed in the upper tool, the engaging member being urged in the direction toward the upper tool support portion; and a clamping force giving means provided in the holder main body, the clamping force giving means pressing the upper portion side of the upper tool clamp to give a clamping force to the upper tool clamp so that the upper tool clamp can clamp the upper tool with the upper tool support portion, wherein the tip portion of the engaging member is positioned at a position nearer to the upper tool support portion side than the vertical surface passing through the fulcrum of the swinging center of the upper tool clamp, when the lower end portion of the upper tool clamp is in the state of being most separated from the upper tool support portion of the holder main body.

Accordingly, the tip portion of the engaging member a little rises and acts so that the upper tool may adhere to the upper tool support portion, when rotating from the state where the upper tool clamp releases the upper tool to the position where the upper tool clamp fixes the upper tool.

In other words, when the upper tool clamp rotates so as to fix the upper tool, the tip portion of the engaging member positioned in the state where the upper tool clamp releases the upper tool, rises a little, so that the upper tool can surely and closely be fixed to the upper tool support portion.

According to a third aspect of the present invention, as it depends from the first and the second aspect, the upper tool clamp is provided on both front and back sides of the upper tool support portion of the holder main body.

Accordingly, a plurality of upper tools are mounted on both front and back sides of the upper tool support portion of the holder main body, and therefore, the replacement of the upper tool is efficiently performed, and in the meantime, for example, the step bending work can be performed, and the working efficiency of the product is also improved.

According to a fourth aspect of the present invention, as it depends from one aspect among the first to third aspects, the clamping force giving means is a fluid pressure device.

Accordingly, the upper tool clamp is easily operated by the fluid pressure device, so that the upper tool may efficiently be installed to and removed from the holder main body.

According to a fifth aspect of the present invention, as it depends from one aspect among the first aspect to the fourth aspect, the fluid pressure device is arranged such that it simultaneously operates the front and back upper tool clamps.

Accordingly, by operating the fluid pressure device, a plurality of upper tools can efficiently be mounted on both front and back sides of the upper tool support portion of the holder main body.

According to a sixth aspect of the present invention, there is provided an upper tool separating method from an upper tool holding apparatus, comprising the steps of: moving downward properly one end side among both right and left sides of an upper tool relative to an upper tool holder; separating one end side of an engaging groove of the upper tool from one end side of the engaging member provided to the upper tool holder; and gradually moving the engagement and separation between the engaging member and engaging groove from one end side to the other end side so as to separate the upper tool from the upper tool holder.

Accordingly, by inclining downward properly one end side among both right and left sides of the upper tool, one end side of the upper tool is easily separated against the weak urging force of the small engaging split fragment. Once one end side of the upper tool is separated from the engaging split fragment, the separating action from this engaging split fragment is gradually moved to the other end side, so that the upper tool can easily be separated from the holder main body.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENT

Figure 1:
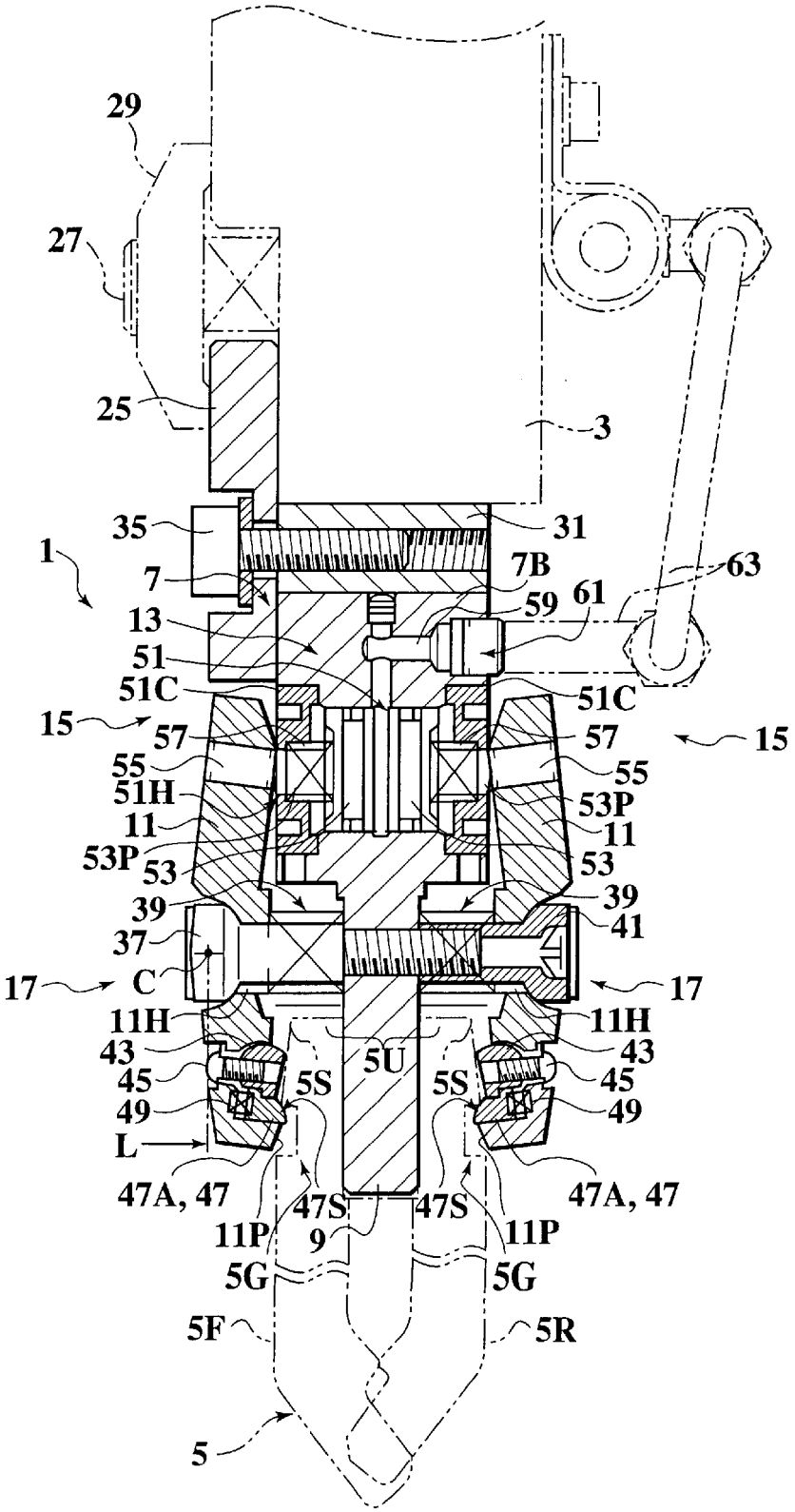
FIG. 1 is a figure showing the state where an upper tool clamp of the embodiment of the present invention is released, and it is a cross sectional view of an upper tool holding apparatus, along the line I—I in FIG. 3.

There will be detailed below the preferred embodiments of the present invention with reference to the accompanying drawings. Like members are designated by like reference characters.

Figure 2:
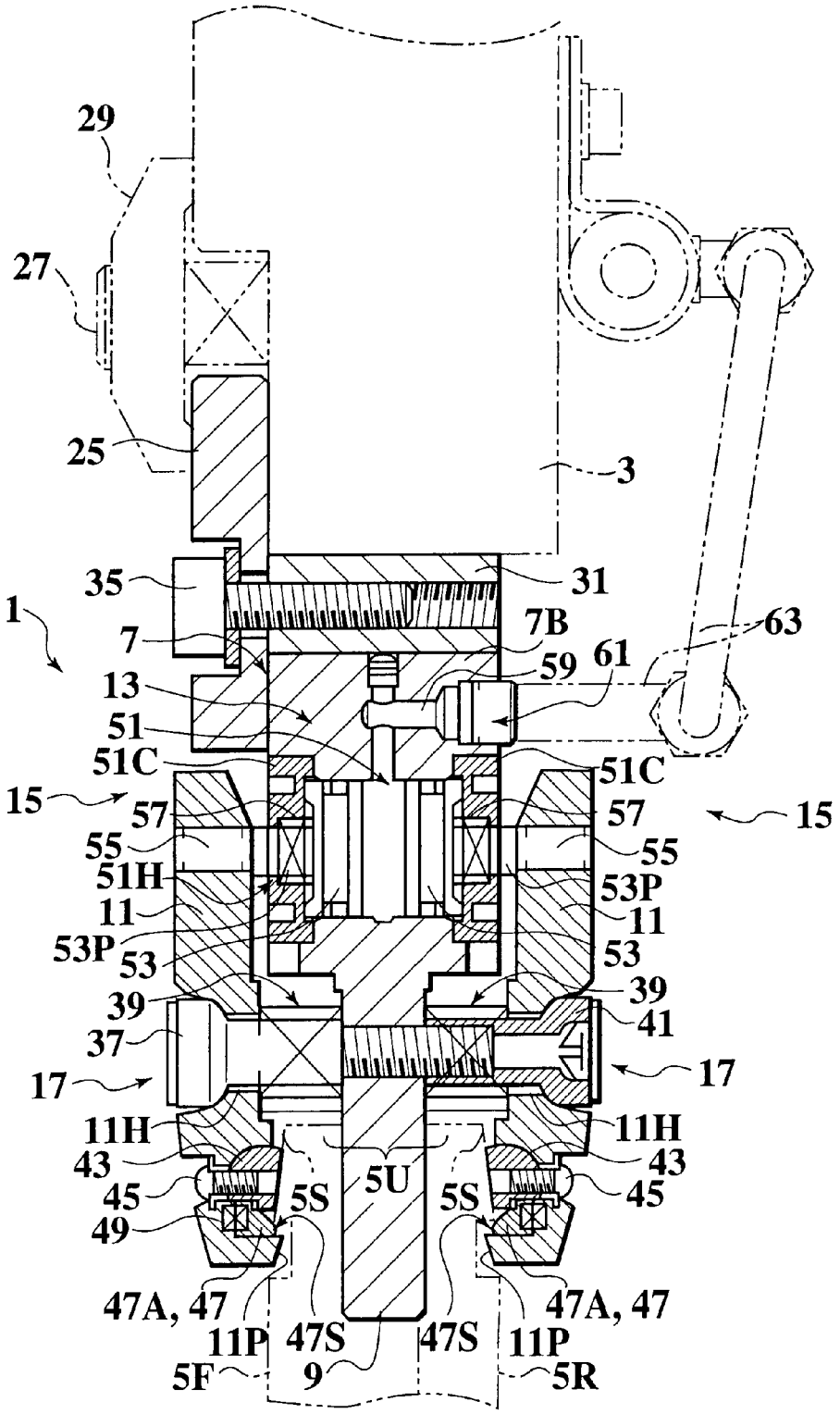
FIG. 2 is a figure showing the state where the upper tool clamp of the embodiment of the present invention is clamping the upper tool, and it is a cross sectional view along the line I—I in FIG. 3.
Figure 3:
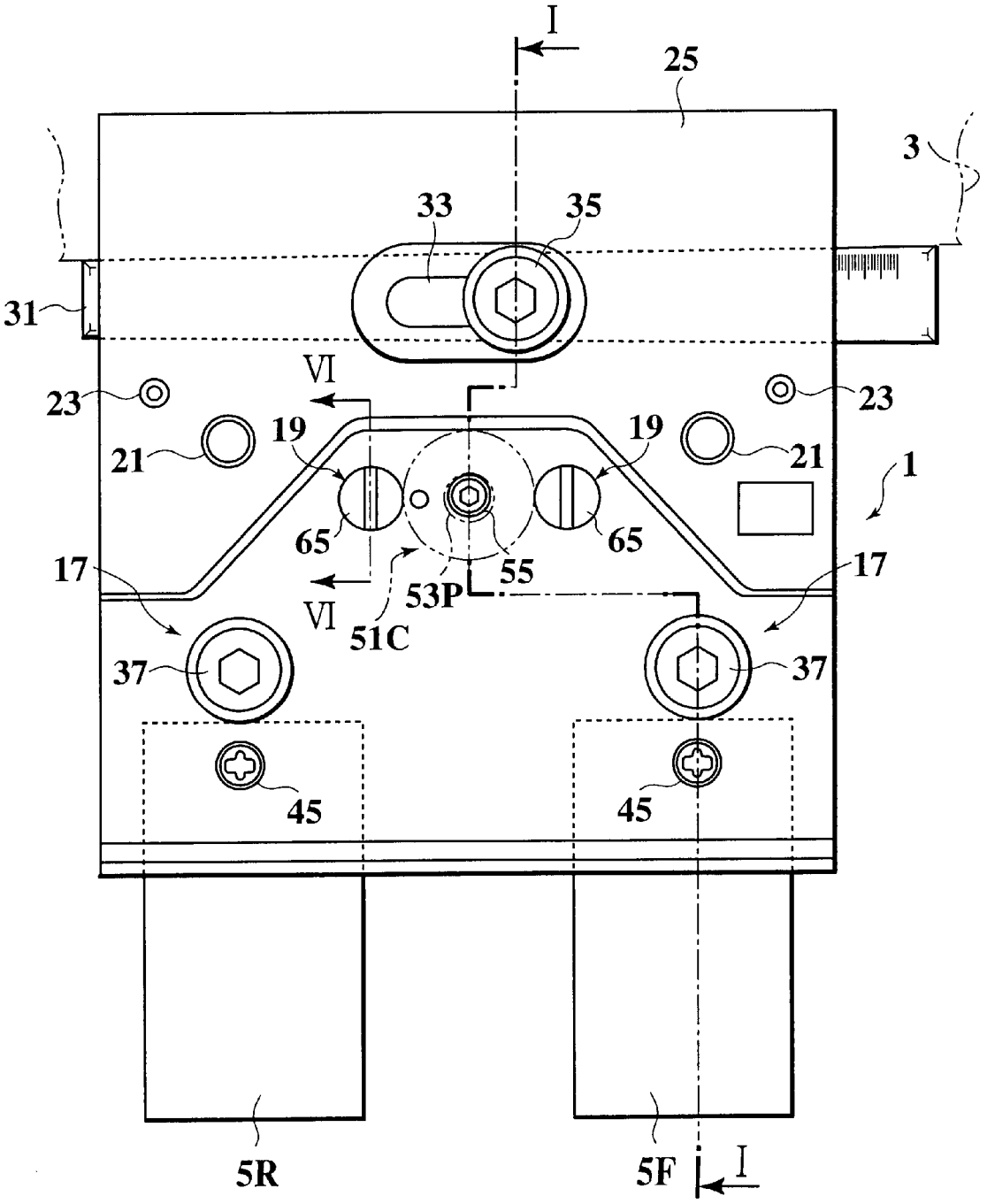
FIG. 3 is a figure showing the embodiment of the present invention, and it is a front view of the upper tool holding apparatus.

As referring to FIG. 1, FIG. 2, and FIG. 3, an upper tool holding apparatus 1 according to the present embodiment is mounted under an upper table 3 in a press brake (total arrangement is omitted in the figure) in such a way that installation and removal are possible. This upper tool holding apparatus 1 is used in such a way that a lot of pieces thereof are mounted at proper intervals in the right and left direction under the upper table 3.

That is, an upper tool 5 in the press brake may be one piece which is long in the right and left direction (vertical direction on the paper in FIG. 1 and FIG. 2, and the right and left direction in FIG. 3) in some cases, and in some cases, it may be used in such a way that a plurality of split types different in length are properly combined, and it is arranged that a lot of upper tool holding apparatus 1 are mounted to the upper table 3 at proper intervals so as to easily deal with both cases.

Figure 6:
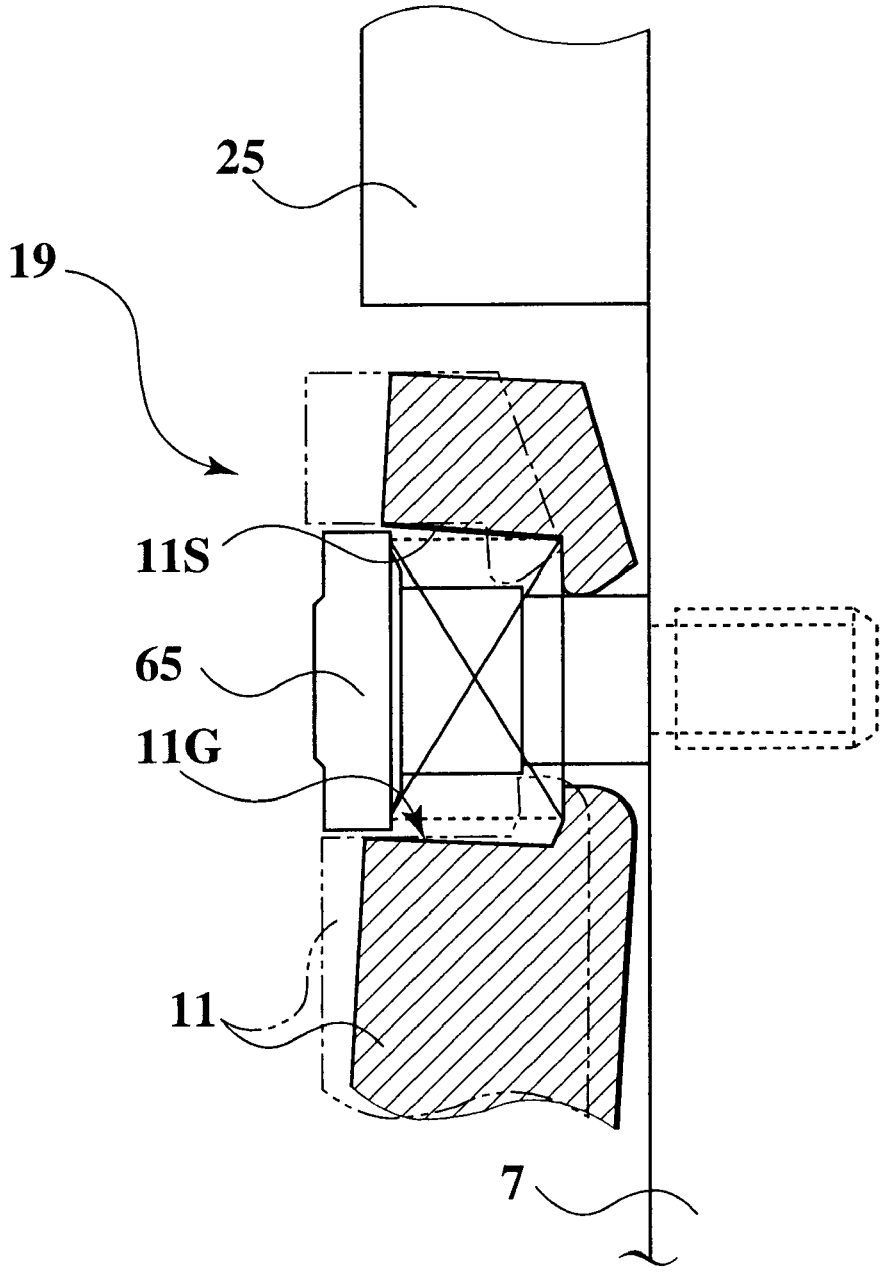
FIG. 6 is a cross sectional view along the line VI—VI in FIG. 3.

As shown clearly in FIG. 1, the upper tool holding apparatus 1 comprises: a holder main body 7 which is mounted to the upper table 3 in such a way that installation and removal are possible; an upper tool clamp 11 which can freely press and fasten an upper portion 5U of the upper tool 5 to an upper tool support portion 9 provided as one piece under this holder main body 7; a clamping force giving means 13 which gives a clamping force to this upper tool clamp 11; a clamp shifting means 15 which can freely transmit and release the clamping force by this clamping force giving means 13 to the upper tool clamp 11; an upper tool clamp keeping means 17 which keeps the upper tool clamp under the holder main body 7 in a freely swingable way; and a release state keeping means 19 which freely keeps the upper clamp 11 in the state where the clamp of the upper tool 5 is released (refer to FIG. 3 and FIG. 6).

More particularly, the holder main body 7 is shaped such that the thin-wall upper tool support portion 9 is provided as one piece under a block portion 7B whose wall is thick in the back and forth direction. At the front (left side in FIG. 1 and FIG. 2) of the block portion 7B of this holder main body 7, a mounting plate 25 projecting upward is attached as one piece with a plurality of bolts 21 and pins 23 (refer to FIG. 3).

As shown in FIG. 3, the mounting plate 25 is shaped to be a mode having a notch widening toward the end at the lower central portion. As shown in FIG. 1, the upper projecting portion of the mounting plate 25 is brought into contact with the front lower portion of the upper table 3, and a clamp jaw 29 is fastened with a fastening bolt 27 screwed in the upper table 3, and the upper projecting portion of the mounting plate 25 is pressed and fastened to the upper table 3, so that the holder main body 7 can be attached to the upper table 3.

By the way, in the present embodiment, the holder main body 7 and the mounting plate 25 are separately provided, and fastened as one piece, but it is also possible to provide the holder main body 7 and the mounting plate 25 as one piece in advance. That is, the mounting plate 25 can be considered as a part of the holder main body 7.

In order to adjust the vertical position of the holder main body 7, a wedge member 31 is put between the upper surface of the holder main body 7 and the lower surface of the upper table 3 in such a way that the position can freely be adjusted in the right and left direction, and into this wedge member 31, a fastening bolt 35 is screwed, which penetrates an elongated hole 33 in the right and left direction formed in the mounting plate 25.

In the above arrangement, the clamp jaw 29 is kept in the state of being fastened weakly to such an extent that the holder main body 7 does not fall, and the wedge member 31 is adjusted in the right and left direction in FIG. 3 in the state where the fastening bolt 35 is loosened, and consequently, the holder main body 7 can finely be adjusted vertically relative to the upper table 3.

The upper tool clamp 11 comprises a plate-like member with a width approximately equal to the width in the right and left direction of the holder main body 7, and an upper projecting portion with the corresponding shape is formed at a part corresponding to the notch portion widening toward the end of the mounting plate 25, and it is supported to the holder main body 7 with the upper tool clamp keeping means 17 in a swingable way, so as to press and fasten the upper portion 5U of the upper tool 5 between that and the upper tool support portion 9.

More particularly, as an upper tool clamp keeping means 17, a plurality of through holes 11H are formed near the central portion in the vertical direction of the upper tool clamp 11, and through this through hole 11H, a mounting bolt 37 is screwed and fastened horizontally on the left side in FIG. 1 of the upper tool support portion 9, and in the meantime, a coil spring 39 which always urges the upper tool clamp 11 in the pressing direction to keep it at the head portion of the mounting bolt 37, is elastically provided, and the upper tool clamp 11 is supported in a freely swingable way.

Furthermore, a mounting nut 41 penetrating the through hole 11H of the upper tool clamp 11 on the right side in FIG. 1, is screwed and fastened onto the screw portion of the mounting bolt 37 horizontally projecting to the right side in FIG. 1 of the upper tool support portion 9, and in the meantime, the coil spring 39 which always urges the upper tool clamp 11 in the pressing direction to keep it at the head portion of the mounting nut 41, is elastically provided, and the upper tool clamp 11 is supported in a freely swingable way.

Furthermore, in order that the swing of the upper tool clamp 11 may smoothly be performed, the contact portions of each head portion of the mounting bolt 37 and mounting nut 41, and the through hole 11H are formed to be spherical contact surfaces.

At the lower end portion of the upper tool clamp 11, an engaging projection 11P which can freely be engaged with a falling preventing groove 5G in the right and left direction formed in the upper portion of the upper tool 5, are formed projecting in the direction of the upper tool support portion 9. A little above this engaging projection 11P, a pressing member 43 is provided, which comes into contact with an inclined plane 5S of the upper portion 5U of the upper tool 5 and presses the upper tool 5 to the upper tool support portion 9.

This pressing member 43 has such a shape that a part of the peripheral surface of a column is processed to be a plane surface, and it is a little rotatably attached under the upper tool clamp 11 through a plurality of screws 45.

Furthermore, above the engaging projection 11P, and between that and the pressing member 43, a wedge piece 47 (engaging member) which can freely be engaged with the falling preventing groove 5G of the upper tool 5, is provided in such a way that the advance and retreat are free. This wedge piece 47 is always urged in the direction of being engaged with the falling preventing groove 5G, by the action of an elastic member 49 such as a coil spring provided elastically between that and the upper tool clamp 11.

The movement of the wedge piece 47 by the urging force is restricted by the contact of a part of the wedge piece 47 with a part of the pressing member 43, and at the upper surface of the tip portion of this wedge piece 47, an inclined plane 47S is formed so that the engagement and separation to the falling preventing groove 5G can easily be performed. FIG. 1 shows the inclined plane 475 in contact with an upper lip of the falling preventing groove 5G.

Figure 4:
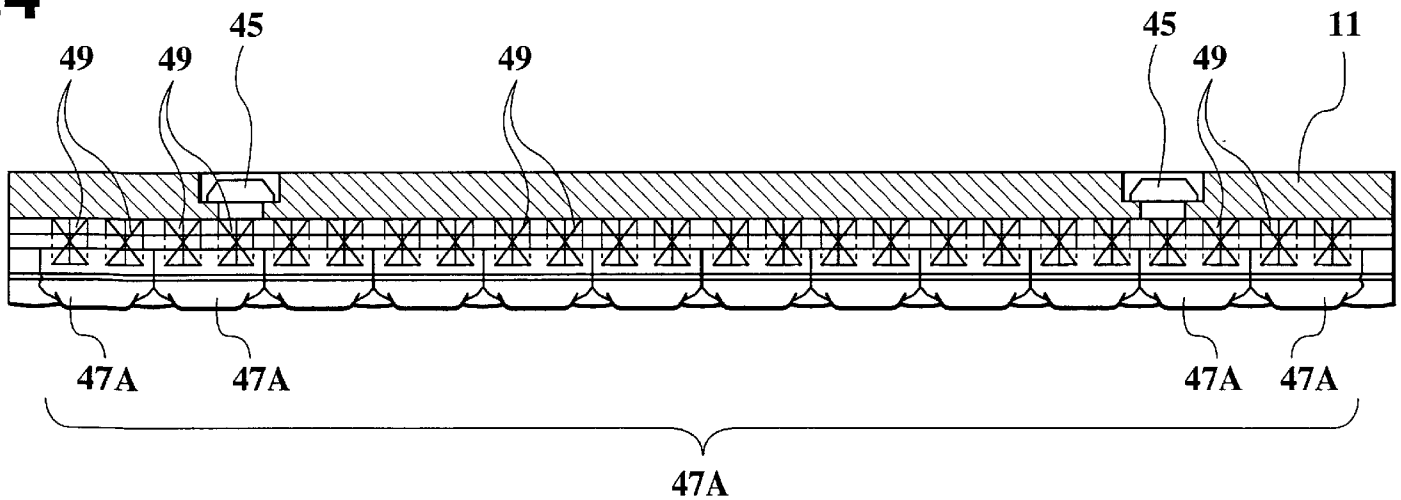
FIG. 4 is a figure showing the embodiment of the present invention, and it is a top view of an engaging member comprising a plurality of engaging split fragments.
Figure 5:
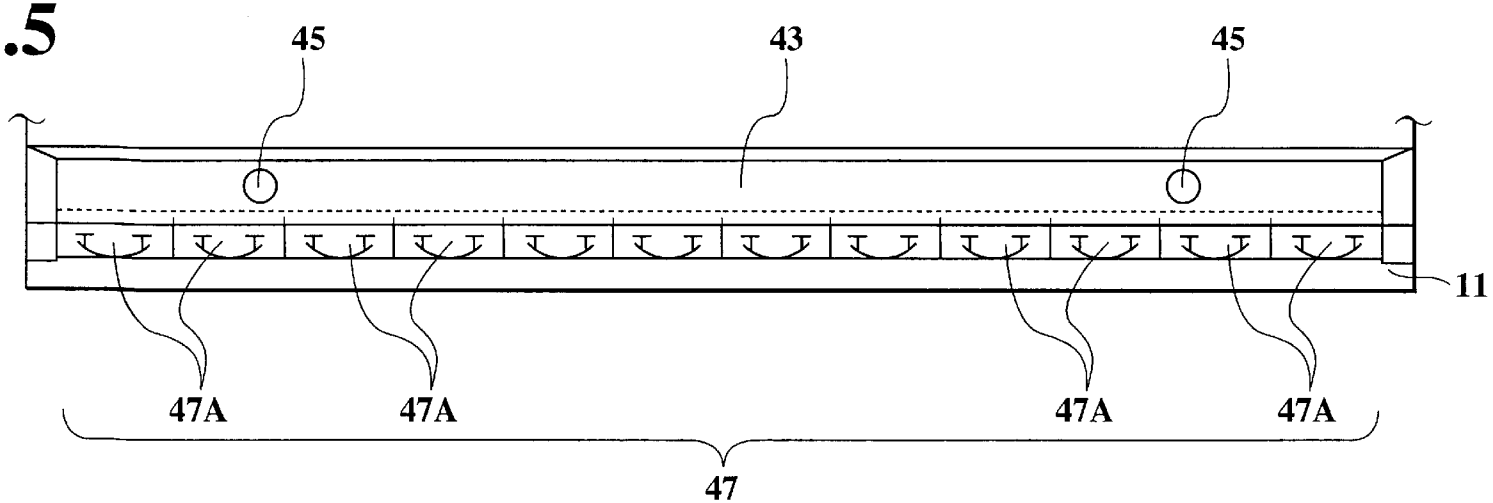
FIG. 5 is a figure showing the embodiment of the present invention, and it is a front view of the engaging member comprising a plurality of engaging split fragments.

More particularly, as shown in FIG. 4 and FIG. 5, the wedge piece 47 comprises a plurality of wedge piece split fragments 47A (engaging split fragments), and each wedge piece split fragment 47A is always urged in the direction of being engaged with the falling preventing groove 5G, by two elastic members 49 in the present embodiment.

The clamping force giving means 13 which gives, to the upper tool clamp 11, the clamping force for pressing and fastening the upper tool 5 to the upper tool support portion 9 with the pressing member 43 provided under the upper tool clamp 11, is contained in a cylinder 51 in the back and forth direction provided to the block portion 7B of the holder main body 7.

More particularly, as shown in FIG. 1, in the clamping force giving means 13, both sides in the back and forth direction of the cylinder 51 are blocked up with the cover portion 51C, and two pieces of pistons 53 are slidably provided in the back and forth direction in the cylinder 51. To each piston 53, a pin-shaped pusher portion 53P is projectingly mounted toward the outside of the cylinder 51, and this pusher portion 53P is projected to the outside from the through hole 51H provided in the cover portion 51C. The tip of each pusher portion 53P is provided in such a way that it can contact with and can be separated from the pressing screw 55 as a pressure receiving portion provided above the upper tool clamp 11. Furthermore, the pressing screw 55 is provided to the upper portion of the upper tool clamp 11 in such a way that advance and retreat and adjustment are free.

Furthermore, to the pusher portion 53P of each of the pistons 53, an elastic member 57 such as a coil spring for always urging each piston 53 in the pressing direction to the inside, is wound as a member making up a part of the clamp shifting means 15. Furthermore, in the block portion 7B of the holder main body 7, an oil passage 59 leading into the cylinder 51 between the two pieces of pistons 53 is formed, and this oil passage 59 is leading to the pressure oil supply hole 61 provided in the side wall surface of the block portion 7B, and to this pressure oil supply hole 61, a pressure oil supply source (omitted in the figure) is leading through a hydraulic hose 63.

As shown in FIG. 3 and FIG. 6, the release state keeping means 19 which can freely keep the upper tool clamp 11 in the state where the clamp of the upper tool 5 is released, is arranged such that a spring support 65 engaged with an engaging hole portion 11G formed in the upper portion of the upper tool clamp 11 through an elastic member 11S such as a spring, is fastened to the holder main body 7, and the upper portion of the upper tool clamp 11 is always urged in the pressing direction toward the holder main body 7 by the elastic member 11S.

In such an arrangement as mentioned above, as the upper tool 5 is shown by the imaginary line in FIG. 1, in the state where the upper tool 5 is clamped between the upper tool support portion 9 of the holder main body 7 and the upper tool clamp 11, when the pressure oil is supplied into the cylinder 51 in the clamping force giving means 13, each piston 53 advances to the outside against the urging force of the elastic member 57, and the tip of the pusher portion 53P comes into contact with the pressing screw 55 of the upper tool clamp 11, so that the pressing force (clamping force) of the cylinder 51 may be transmitted.

Accordingly, by the pressing force (clamping force) of the cylinder 51, such a mode that the upper tool clamp 11 on the left side in FIG. 2 is turned counterclockwise and the upper tool clamp 11 on the right side in FIG. 2 is turned clockwise, arises, and the upper tool clamps 11 more intensely press and fasten the upper tools 5F, 5R.

On the contrary, when the pressure oil is discharged into the cylinder 51, each piston 53 retreats to the inside by the urging force of the elastic member 57, and the tip of the pusher portion 53P moves in the direction of being separated from the pressing screw 55 of the upper tool clamp 11, and the pressing force (clamping force) of the cylinder 51 is released.

Accordingly, as shown in FIG. 6, the upper portion of the upper tool clamp 11 is moved to the holder main body 7 side by the elastic member 11S of the spring support 65, and the pressing screw 55 at the upper portion of the upper tool clamp 11 and the pusher portion 53P of the clamping force giving means 13 become in a light contact state, so that the pressing and fastening of the upper tools 5F, 5R by the upper tool clamp 11 may be released. The upper tools 5F, 5R becomes in the state of being supported movably in the longitudinal direction (right and left direction), in the state where the engaging projection 11P of the upper tool clamp 11 is engaged with the falling preventing groove 5G. As mentioned above, the upper tool clamp 11 can easily be operated by the cylinder 51 (fluid pressure device), so that the upper tools 5F, 5R can efficiently be installed to or removed from the holder main body 7.

That is, the lower portion of the upper tool clamp 11 becomes in the mode open in the direction of being separated from the upper tool support portion 9, and such a state that the upper tool 5 can be installed to or removed from or replaced with the upper tool clamp 11 in the vertical direction, arises.

Furthermore, in the state where the lower end portion of the upper tool clamp 11 is separated from the upper tool support portion 9 of the holder main body 7 to the utmost, the tip portion of each wedge piece split fragment 47A making up the wedge piece 47 is located at a position nearer to the side of the upper tool support portion 9 than the vertical surface L passing through the swing center C of the upper tool clamp 11.

Accordingly, the tip portion of each wedge piece split fragment 47A in the state where as shown in FIG. 1, the upper tool clamp 11 has released the upper tools 5F, 5R, a little rises and becomes in the mode of adhering the upper tools 5F, 5R to the upper tool support portion 9, when as shown in FIG. 2, the upper tool clamp 11 turns to fasten the upper tools 5F, 5R.

By the way, in the above arrangement, in order to mount the upper tools 5F, 5R to the upper tool holding apparatus 1 from the lower side, the upper portions 5U of the upper tools 5F, 5R are inserted from the lower side between the upper tool support portion 9 of the holder main body 7 and the upper tool clamp 11, in the state where the lower portion of the upper tool clamp 11 is open in the direction of being separated from the upper tool support portion 9. At this moment, the tip of the engaging projection 11P of the upper tool clamp 11 is open in the state where the upper portion 5U of the upper tool 5 can be inserted, and the tip portion of each wedge piece split fragment 47A is in the state of projecting to the side of the upper tool support portion 9 from the upper portion 5U.

Each wedge piece split fragment 47A is small, and in the meantime, it is individually and independently urged to the side of the upper tool support portion 9 by the elastic member 49 such as a weak spring, and therefore, the inclined planes 5S of the upper tools 5F, 5R can raise the upper tools 5 while easily pushing to the outside the tip portion of each wedge piece split fragment 47A individually against the urging force of the elastic member 49, and the tip portion of each wedge piece split fragment 47A can easily be engaged with the falling preventing groove 5G of the upper tool 5.

When separating the upper tools 5F, 5R from the upper tool holding apparatus 1, properly one end side among both right and left sides of the upper portions 5U of the upper tools 5F, 5R is inclined downward in the state where the lower portion of the upper tool clamp 11 is open in the direction of being separated from the upper tool support portion 9, and consequently, one end side of the upper tool 5 slides on the inclined plane 47 of the tip portion of the wedge piece split fragment 47A, and the falling preventing groove 5G of the upper tool 5 is easily separated from the tip portion of the wedge piece split fragment 47A, while easily pushing it to the outside against the urging force of the elastic member 49 of the small wedge piece split fragment 47A. When one end side of the upper tool 5 is separated from the wedge piece split fragment 47A, the upper tools 5F, 5R can easily be separated from the holder main body 7, by gradually shifting the engagement and separation from the wedge piece split fragment 47A, to the other end side.

As mentioned above, the upper tools 5F, 5R can individually and easily be installed to and removed from a proper position in the right and left direction on the front side and back side of the upper tool holding apparatus 1, as shown by the upper tool 5F on the front side and the upper tool 5R on the back side in FIG. 1 and FIG. 3. Accordingly, a plurality of upper tools 5F, 5R are mounted on both front and back sides of the upper tool support portion 9 of the holder main body 7, so that the replacement of the upper tool may efficiently be performed and the working efficiency of the product may also be improved.

By the way, this invention is not limited to the example of the above embodiment, but it can be practiced in other modes by performing proper modifications.

While preferred embodiments of the present invention have been described using specific terms, such description is for illustrative purposes, and it is to be understood that changes and variations may be made without departing from the spirit or scope of the following claims.

What is the claimed is:

1. An upper tool holding apparatus, comprising:

a holder main body;

an upper tool, the upper tool comprising a falling preventing groove formed in the upper tool, the falling preventing groove comprising an upper lip thereof;

an upper tool support portion provided under the holder main body to support the upper tool;

an upper tool clamp which is supported in a swingable way with a fulcrum near the approximately central portion in the vertical direction of the holder main body;

a pressing member provided at a lower portion of the upper tool clamp to press the upper tool to the upper tool support portion;

an engaging member provided at the lower portion of the upper tool clamp, the engaging member provided to freely be engaged with the falling preventing groove formed in the upper tool, an elastic member urging the engaging member in a direction toward the upper tool support portion; and wherein the engaging member comprises an inclined plane facing the upper lip of the falling preventing groove, whereby engagement and separation of the engaging member to the falling preventing groove is easily performed;

a clamping force giving means provided in the holder main body, the clamping force giving means pressing the upper portion side of the upper tool clamp to give a clamping force to the upper tool clamp so that the upper tool clamp can clamp the upper tool with the upper tool support portion, wherein the engaging member is provided by being divided into a plurality of pieces as engaging split fragments; and the respective divided engaging split fragments are respectively provided by being urged in the direction of the upper tool support portion.

2. An upper tool holding apparatus according to claim 1, wherein a tip portion of the engaging member is positioned at a position nearer to an upper tool support portion side than a vertical surface passing through the fulcrum of a swinging center of the upper tool clamp, when the lower end portion of the upper tool clamp is in a state of being most separated from the upper tool support portion of the holder main body.

3. An upper tool holding apparatus according to claim 2, wherein the upper tool clamp is provided on both front and back sides of the upper tool support portion of the holder main body.

4. An upper tool holding apparatus according to claim 3, wherein the clamping force giving means is a fluid pressure device.

5. An upper tool holding apparatus according to claim 4, wherein the fluid pressure device is arranged such that it simultaneously operates the front and back upper tool clamps.

* * * * *